United States Patent [19]

Hasselbacher et al.

[11] 4,272,941

[45] Jun. 16, 1981

[54] THERMALLY-INSULATING CONNECTING ELEMENTS FOR COUPLING TWO COMPONENT PARTS, AND ALSO COMPOUND, THERMALLY-INSULATING PROFILE MEMBERS AND A PROCESS FOR THEIR MANUFACTURE

[75] Inventors: Wilhelm Hasselbacher, Neustadt; Wolfgang Schalm, Munich, both of Fed. Rep. of Germany

[73] Assignee: Annemarie Hasselbacher, Neustadt, Fed. Rep. of Germany

[21] Appl. No.: 893,000

[22] Filed: Apr. 3, 1978

[30] Foreign Application Priority Data

Apr. 4, 1977 [DE] Fed. Rep. of Germany ..... 2714999
Apr. 4, 1977 [DE] Fed. Rep. of Germany ..... 2715010

[51] Int. Cl.[3] ..... E04C 3/30
[52] U.S. Cl. ..... 52/731; 49/DIG. 1

[58] Field of Search ..... 52/730, 403, 731, 402; 49/DIG. 1

[56] References Cited

U.S. PATENT DOCUMENTS

| | | | |
|---|---|---|---|
| 3,878,660 | 4/1975 | Jacob | 52/403 |
| 3,925,953 | 12/1975 | LaBorde | 49/DIG. 1 |
| 4,115,972 | 9/1978 | Varlonga | 52/403 X |
| 4,157,641 | 6/1979 | Hasselbacher | 49/DIG. 1 X |
| 4,158,512 | 6/1979 | Hasselbacher | 49/DIG. 1 X |

*Primary Examiner*—Price C. Faw, Jr.
*Assistant Examiner*—Carl D. Friedman
*Attorney, Agent, or Firm*—Burgess, Ryan and Wayne

[57] ABSTRACT

Disclosed is a thermally-insulating connecting device for the coupling of two components comprising a resiliently deformable connecting element which is insertable into receiving channels on the components and is deformed in place by the insertion of a locking element.

23 Claims, 8 Drawing Figures

Figure 1:
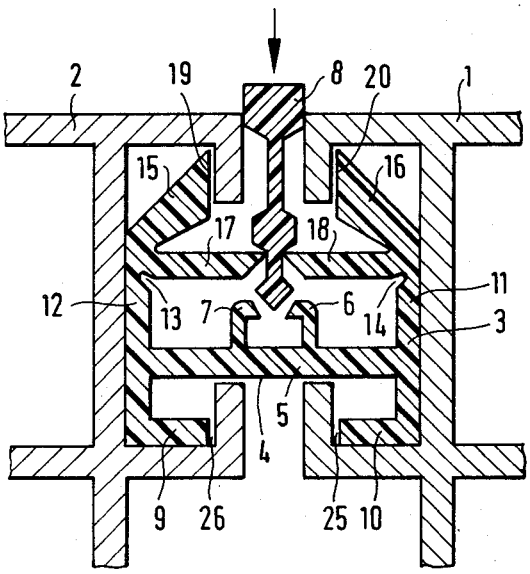

THERMALLY-INSULATING CONNECTING ELEMENTS FOR COUPLING TWO COMPONENT PARTS, AND ALSO COMPOUND, THERMALLY-INSULATING PROFILE MEMBERS AND A PROCESS FOR THEIR MANUFACTURE

The invention is concerned with thermally-insulating connecting elements of grooved design, which are easily pushed together to form members, and which are designed so that a nearly u-shaped cross-section is provided with projections which act on wedge-shaped surfaces of c-shaped slots, if the connecting triangles situated at the ends of the profiles are placed in the appropriate position over additional devices or additional elements.

The invention also concerns the manufacture of thermally-insulating metal profiles which are designed so that a compound profile member, consisting of two metal profile parts arranged parallel to each other, can be coupled by means of a compound thermally-insulating connecting element. The thermally-insulating connecting element has projections or slots which interact with the metal profile parts so that after insertion of a further thermally-insulating connecting element, a spring-actuated connection is formed for the two parallel metal profile parts.

In previously known component connections, it has been necessary to push the connecting elements into the slots provided, which have been finished to give an accurate fit, and after the insertion metal deformation must occur. This type of connection requires extensive outlay in machinery.

Furthermore, cold crack formation occurs in the deformed component ridges which significantly affects the stability of the component. Usually such components are constructed after anodic oxidation or other surface treatment, so that the surface becomes damaged by crack formation in the region of any deformation.

Other variants for component connections, involve positioning a connecting element, which is usually opposite, in the slots provided in the component, so that an empty space is formed between them. This empty space is filled with expanding foam so that a plastic fillet is held in the slot in accordance with its shape. This type of connection is costly and requires extensive outlay in machinery. Furthermore, experience has shown that this type of connection is prone to variations in dimensions and to vibrations, which cause solidification of the plastic. As a result, the two profiles are pushed towards one another and inaccuracies in the dimensions occur with these variants.

A further possible solution is to use two-part connecting strips, which are joined to each other in the operating position. Such connecting strips have the disadvantage that the components are not held together, but are braced against each other by the inserted connecting strip.

Compound profile members for window or door frames are known, which consist of two metal profile parts and one or two thermally-insulating connecting elements. If the thermally-insulating connecting element is in one piece, then manufacture involves difficulties. The metal profile can only be produced in specially equipped factories from either connecting elements which are pushed together, or with connecting elements which are provided with grooves into which the metal profile member is locked under continuous deformation.

Other connecting elements are known, which are designed in two parts, these connecting together by means of hook-shaped projections. Removal of the connection from the metal profile is impossible.

Another type of connection for combined metal parts, consists of thermally-insulating plastic plates placed between overlapping ridge projections. The two metal profile parts are connected together by means of screws, rivets or special connecting parts.

Another type of insulating metal profile is obtained by inserting at least two thermally-insulating connecting elements into slots in the metal profile parts. After the metal profile parts have been aligned, plastic foam is forced into the empty space with extensive outlay in machinery. Expansion of the plastic foam causes the previously-inserted connection elements to be pressed into grooves in the metal profile parts, and joins the profile parts together by its shape. The foam connection can become loose as a result of stress due to thermal changes in the metal profile parts. Parts replacement in the metal profiles is not possible with this type of connection. This is particularly disadvantageous when visible surfaces on the connected metal profile parts are damaged during transportation.

Previously thermally-insulating metal profiles for window or door frames could not be subjected to anodic oxidation or stove enamelling after the two metal profile parts had been combined. The high processing temperatures—100° or 180°—cause deformation of the thermally-insulating connecting elements, and residual deformation on cooling makes it impossible to use the metal profiles.

Processes for the manufacture of metal profiles are known, in which compound, thermally-insulating connecting elements are combined on the zip-fastener principle, between pairs of rollers. This type of manufacturing process requires extensive outlay in tools and machines.

Also there are variations for thermally-insulating connecting elements which consist of foamed-in hard plastic foam and which require much expense in finishing.

The novelty lies in making available, economic thermally-insulating connecting elements, which allow rough tolerances in the components and which require a small outlay in tools and machines, and in a connecting element which is designed so that it can be produced with the simplest of equipment and machinery and so that damaged metal profile parts can be exchanged.

This aim has been achieved according to the invention, by the fact that the external dimensions of the connecting element are smaller than the slots or projections on the component. In this way it is possible for the connecting element to be pushed easily into the slots provided. Furthermore, the components can e arranged beneath each other before the final operating position is reached. Two pairs of connecting triangles, which are positioned behind the side-ridges in the region where the material tapers, are deformed by additional elements or additional equipment such as rollers, so that the components are held together by swivelling. After the support ridge has been caught in the projection provided for this, the tolerance-absorbing component connection is completed.

A further advantage of the invention is that the connection can be released for damaged components. This is achieved by unlocking the projections so that the connecting triangle returns to its unstressed position. The connecting element can then be removed from the slot and the component can be changed. This is particularly useful, since it has become evident in practice, that for example, light metal profiles often become damaged on one side during transportation. Reuse of the connecting elements is possible for such replacements.

Another advantage of the invention, is that a connecting element can be pushed into the slots running along the length of the metal profile parts, at its ends to give at least two component connections. The connection thus formed fixes the distance of the metal profile parts from each other. On at least one side of the thermally-insulating connecting elements are claw-like projections, into which a second connecting element can be fixed. The design of the hammerhead-shaped second connecting element is chosen so that both connecting elements operate together through inclined surfaces at the foot of the perpendicular. The design of the connecting element according to the invention, with inclined surfaces which are locked into projections on the metal profile parts produces a closure which is limited by the first connecting element, in all pushable directions. The interlocking of the connecting elements with each other is such that large tolerance variations in the metal profile parts are permissible. The limit is fixed, according to the invention, by the total length of the arm of a connecting element. The clamp support of the connecting element ensures through barb-shaped catches, according to the invention, that a uniform spring-actuated applied pressure always acts on the projections of the metal profile shapes.

The design of the connecting elements makes it possible to open the connection again. Unlocking of one connecting part from the barb-shaped catch permits the remaining connecting element to be removed from the slots of the metal profile parts so that the latter can be partially renewed in the case of damage. A further advantage of this invention, is that the connecting elements can be used again.

Figure 2:
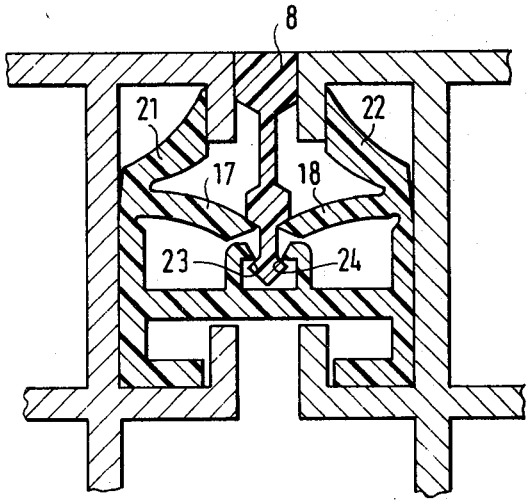
Figure 3:
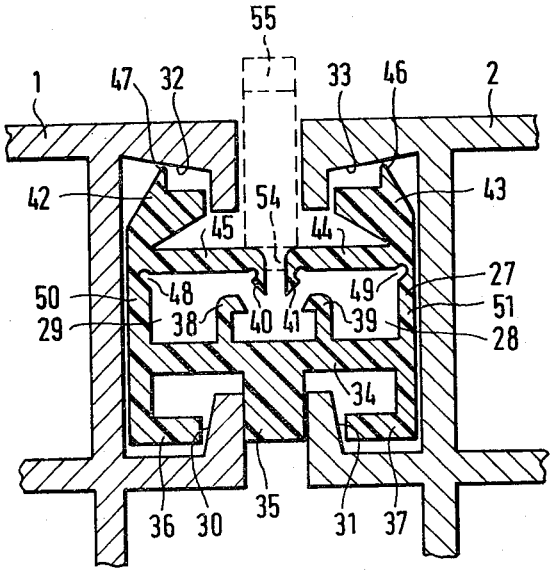
Figure 4:
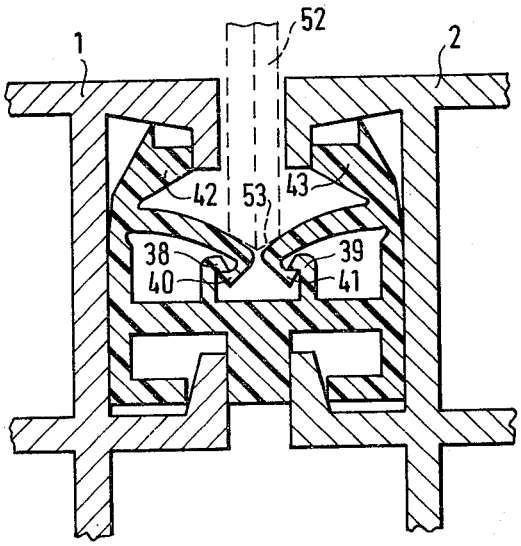
Figure 5:
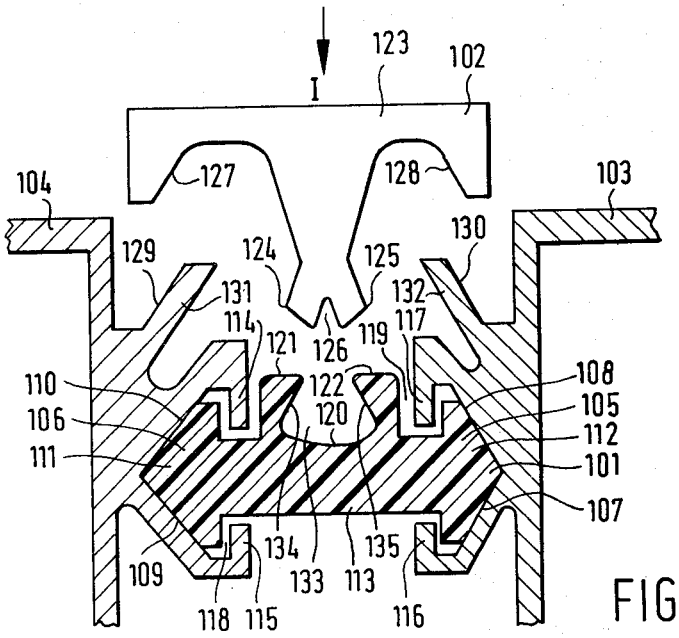
Figure 6:
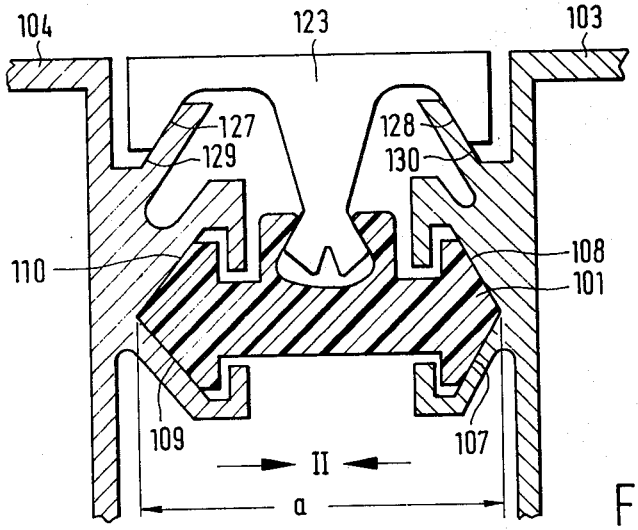
Figure 7:
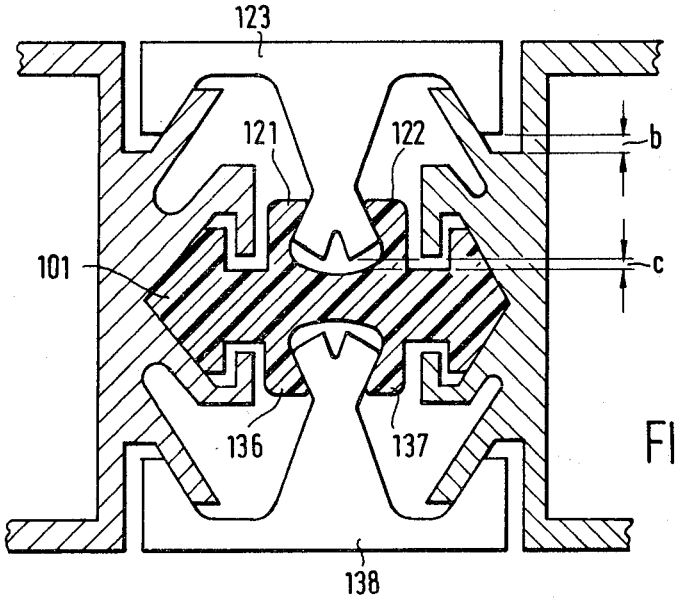
Figure 8:
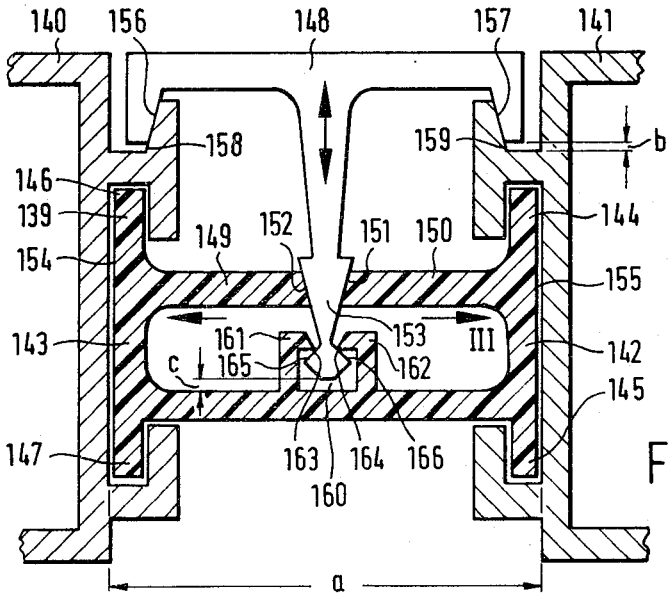

The drawings show examples of designs. These are:

FIG. 1 A connecting element in the insertion position, not the operating position;

FIG. 2 A connecting element for two components in the operating position;

FIG. 3 A connecting element for two components, which is formed from a single piece, in the insertion position;

FIG. 4 A connecting element for two components in the operating position, showing an auxiliary device;

FIG. 5 A detail drawing in which a two-part connecting element is shown, but not in the operating position;

FIG. 6 A detail drawing in which the two-part connecting element is in the operating position;

FIG. 7 A cross-section in which the two-part connecting element has a mirror-image symmetrical arrangement on the reverse side;

FIG. 8 A cross-section in which the two-part element has another volumetric shape, by means of which additional bracing can be achieved through a transverse ridge.

FIG. 1 shows two components, 1, 2, which are connected together by the connecting element 3. The connecting element 3, has a transverse ridge on its under surface 4. Catch projections 6, 7 are arranged on this transverse ridge, and these accept an additional connecting element 8. The nearly u-shaped connecting element 3, has extension arms 9, 10, which are linked to the base surface 4.

There are material taperings 13, 14 on both side walls 11, 12, to which a pair of connecting triangles is linked. The pair of connecting triangles has extension arms 17, 18 which interact with the additional connecting element 8. If the additional element 8, moves in the direction of the arrow, the connecting triangles 15, 16, push against the internal surfaces 19, 20 and draw the two components 1, 2 together.

FIG. 2 shows components 1, 2 and the connecting elements 3, 8 in the operating position. The two extension arms 17, 18 are tensioned by the additional connecting element 8, so that the extensions 21, 22 lie on the internal surfaces 19, 20 as a result of spring actuation. The additional connecting element 8 is held by the catch projections 6, 7 being locked by spring actuation onto the inclined surfaces 23, 24.

The spaces 25, 26 between the components 1, 2 and the connecting element 3, are closed in the finishing process.

FIG. 3 shows another volumetric shape for the connecting element 3. The components 1, 2 are connected by a connecting element 27, of different design, by the c-shaped slots 28, 29. The slots 28, 29 have wedge surfaces 30, 31, 32, 33 which equilibrate variations in dimensions. The dimensions of the c-shaped slots 28, 29 are kept larger than the external dimensions of the connecting element 27. Easy insertion is therefore guaranteed. An extension 35 is arranged on a base surface 34, which gives the distance between the components 1 and 2. The two extension arms 36, 37 act on the wedge-shaped surfaces 30, 31 and give a shape-actuated connection for the two components 1, 2.

On the back of the base surface 34, are provided catching projections 38, 39 which interact with the clamps 40, 41. The connecting triangles 42, 43 are thus moved so that the extension arms 44, 45 are deformed. Projections 46, 47 are present on the linking triangles 42, 43, which lock onto the wedge surfaces 32, 33. As soon as the connecting triangles are moved, the connecting element 27, is pressed with shape-actuation, onto the wedge-shaped surfaces 30, 31.

Better movement of the connecting triangles 42, 43 is achieved if material taperings 48, 49 are present on the side ridges 50, 51. The material taperings also form a point of rotation for the connecting triangles.

FIG. 4 includes the operating position for the connection between the components 1 and 2. The clamps 40, 41 are locked into the catching projections 38, 39 so that the two components 1 and 2 are held together by spring actuation by means of the connecting triangles 42, 43. The extension arms 36, 37 and the projections 46, 47 are in contact with the ridge surfaces 30, 31, 32, 33, so that closure is obtained in the slots 28, 29.

In order to facilitate mounting, rollers or drums are provided, 52, by means of which the operating position of the connecting element 27, is reached. The rollers of drums 52, have correctly contoured surfaces 53, which deform the extension arms 44, 45 to the correct shape.

Alternatively as shown in dotted lines in FIG. 3, the extension arms 44, 45 can be formed in a single piece. This gives a considerable price reduction for the manufacture of the connecting element 27. Catching projections 40, 41 can also be envisaged on the single-piece extension arm 54, which interact with the catching projections 38, 39. Material taperings can be provided in the middle region of the single-piece extension arm 54, which serve as standardised breaking points.

A further alternative for mounting the connecting element 27, involves providing a pin 55, in place of the rollers or drums 52, which fulfills the same function. Projections or indentations are arranged on the pin 55, which make easy dismantling possible.

In FIGS. 5–8, thermally-insulating connecting elements are shown shaded, and all interlocked connecting parts combined with them are not shaded.

In the drawing FIG. 5, a two-part connecting strip is shown, in which the metal profile parts 103, 104 are connected with each other in the slots 105, 106, by the connecting strip 101. The slots 105, 106 have centred inclined surfaces 107, 108, 109, 110 and the parallel head 111, 112 of the connecting section comes into contact with these by clamping. The cross-section of the connecting element 101 is chosen so that the compression forces which build up from the connection, can be accepted. The cross-section 13 serves as an abutment for the inclined surfaces 107, 108, 109, 110. The metal profile parts 103, 104 grip the connecting unit with their flanges 114, 115, 116 and 117, so that slot-shaped spaces are formed. The measurements can be chosen so that air spaces 118, 119 are formed between the connecting element 101 and the metal profile parts 103, 104.

Hook-shaped catches 121, 122 are arranged on the base surface 120 of the connecting element 101, which interact with a further thermally-insulating connecting element 123. The connecting element 123 is designed as a hammerhead and has catching projections 124, 125 at is wedge-shaped end and these lock on behind the hook-shaped projections 121, 122. Greater elasticity in the catching projections 124, 125 should be produced by the gap 126. The connecting element 123 is provided with inclined surfaces 127, 128 at its lower end. These inclined surfaces combine with the profile surfaces 129, 130 present as profile projections 131, 132 on the metal profile parts 103, 104. The inclined surfaces act to ensure that the two metal profile parts 103, 104 are pushed together until the contacting surfaces 107, 108, 109, 110 are in contact with the connecting element 101. The further the metal profile parts 103, 104 are pushed towards each other, the deeper is the thermally-insulating connecting element 123 inserted into the pocket-shaped opening 133. A spring-actuated connection is thus produced by the connecting elements acting together, the catching projections 124, 125 acting on the inclined surfaces 134, 135, so that the connecting element 123 is drawn into the pocket 133.

FIG. 6 shows the operating position of the connecting elements 101 and 123. The profile surfaces 107, 108, 109, 110 now lie on the metal profile parts 103, 104 and exert a pull in the direction of the arrow.

Another variant for the design of two-part connecting elements is shown in FIG. 7, and consists of a mirror-image arrangement of catching projections 121, 122 on the connecting element 101 on the acceptance side facing the connecting element 123. It is thus possible that as in the case of the catching projections 121, 122, a connecting element 138 of similar profile can be inserted into the projections 136, 137, like the connecting element 123. This type of connection can, according to the invention, be chosen where small profile cross-sections are used.

FIG. 8 shows a two-part connecting element in which the profile part 139 has another volumetric shape. The metal parts 140, 141 have slot-shaped sections 142, 143 into which the projecting ridges 144, 145, 146, 147 are inserted. The required profile spacing for the metal profile parts 140, 141 is determined by the connecting element 143. According to the penetration of the second connecting element 148, these are inserted into the extension arms 149, 150 of the connecting element 143, which is arranged perpendicular to the side limiting surface. The interspace 153, is increased by movement of the extension arms 149, 150 in the direction of the arrow, by means of the inclined surfaces 151, 152. The limiting edges 154, 155 in the c-shaped slots 142, 143 press against the internal walls of the metal profile parts 140, 141. The wedge-shaped connecting element 148 has inclined surfaces 156, 157 on its under side, which lock onto the inclined surfaces 158, 159 and cause a pushing movement of the metal profile parts 140, 141 in the direction of the arrow. The connecting element 148 moves according to the variation in the tolerance of the profiles 140, 141 in the direction of the arrow, and thus guarantees that the space a between the metal profile parts is always the same size. This also applies to FIGS. 5–7. The tolerance equilibration for the connecting elements 143, and 148 is obtained in the pocket 160 by means of the inclined catching projections 161, 162. The tips 163, 164 act on the inclined surface 165 and an inclined surface 166 so that a spring-actuated clamp is always given according to the depth of the connecting element 148.

We claim:

1. A thermally-insulating connecting device intended for the coupling of two components and comprising a resiliently deformable connecting element which is insertable into receiving channels on the components, said connecting element being shaped for engagement within said receiving channels as a result of its shape and, after having been inserted into said receiving channels, being adapted to be changed in its dimensions by inserting a locking element so that a connection of the components is formed by resiliently deforming said connecting element by means of said locking element, to urge said receiving channels, said connecting element comprising internal extension arms forming connecting triangles, whereby the extensions push against internal surfaces of the components when the extension arms are actuated by the locking element, to draw the two components together, said extension arms having the shape of a continuous ridge with catching devices fitted to the underside thereof, said continuous ridge comprising a standardized breaking point which may be broken upon insertion of the locking element.

2. A thermally-insulating connecting device intended for the coupling of two components and comprising a first connecting element which is insertable into receiving channels on the components, said connecting element being shaped for engagement within said receiving channels as a result of its shape and provided with ridges fitting into slots of the components, and further comprising a hammer headshaped second connecting element which is adapted to be locked with the first connecting element by a removable clamping means, and which has inclined wedge surfaces cooperating with corresponding inclined surfaces of projections of the components so that a connection of the components is formed by a wedge action between the second connecting element and the components, a third connecting element disposed symmetrical to the second connecting element and comprising corresponding wedge surfaces and catching means, the dimensions of the second and third connecting elements being chosen so that in the operating position thereof an air space remains between the extensions of said connecting elements and the bottoms of the corresponding channels of the components.

3. A thermally-insulating connecting device intended for the coupling of two components and comprising a resiliently deformable connecting element which is insertable into receiving channels on the components, said connecting element being shaped for engagement within said receiving channels and, after having been inserted into said receiving channels, to be changed in its dimensions by inserting a locking element so that a connection of the components is formed by resiliently deforming said connecting element by means of said locking element, to urge said connecting element against interior walls of each of said receiving channels and position said channels by interaction of (i) a wedging force urging said channels toward each other and (ii) maintaining said channels at a desired distance from each other, said locking element comprising a tool adapted to be removed after mounting the connecting device.

4. A thermally-insulating connecting device intended for the coupling of two components and comprising a resiliently deformable connecting element which is insertable into receiving channels on the components, said connecting element being shaped for engagement within said receiving channels and, after having been inserted into said receiving channels, to be changed in its dimensions by inserting a locking element so that a connection of the components is formed by resiliently deforming said connecting element by means of said locking element, to urge said connecting element against interior walls of each of said receiving channels and position said channels by interaction of (i) wedging force urging said channels toward each other and (ii) maintaining said channels at a desired distance from each other, said connecting element comprising internal extension arms forming connecting triangles, whereby the extensions push against internal surfaces of the components when the extension arms are actuated by the locking element, to draw the two components together.

5. The device according to claim 4, characterized in that the connecting element has a projection arranged intermediate the portions thereof contacting each of said components, said projection acting as a spacing element when the connection has been made.

6. The device according to claim 4, characterized in that standardized bending points are arranged on the side walls of the connecting elements below the connecting triangle.

7. A thermally-insulating connecting device intended for the coupling of two components and comprising a resiliently deformable connecting element which is insertable into receiving channels on the components, said connecting element being shaped for engagement within said receiving channels and, after having been inserted into said receiving channels, to be changed in its dimensions by inserting a locking element so that a connection of the components is formed by resiliently deforming said connecting element by means of said locking element, to urge said connecting element against interior walls of each of said receiving channels and position said channels by interaction of (i) a wedging force urging said channels toward each other and (ii) maintaining said channels at a desired distance from each other, said locking element being removably engaged with the connecting element, said connecting element comprising catch projections arranged intermediate the portions thereof contacting each of said components, said projections cooperating with the locking element and being locked by spring action onto inclined surfaces of the locking element when inserted.

8. The device according to claim 7, characterized in that the extension arms comprise catching projections which cooperate with catching projections in the area of the connecting element intermediate the portions thereof contacting each of said components, when the connection is made by means of the tool.

9. A thermally-insulating connecting device intended for the coupling of two components and comprising a resiliently deformable connecting element which is insertable into receiving channels on the components, said connecting element being shaped for engagement within said receiving channels and, after having been inserted into said receiving channels, to be changed in its dimensions by inserting a locking element so that a connection of the components is formed by resiliently deforming said connecting element by means of said locking element, to urge said connecting element against interior walls of each of said receiving channels and position said channels by interaction of (i) a wedging force urging said channels toward each other and (ii) maintaining said channels at a desired distance from each other, the profile ends of the channels of the components being nearly U-shaped and being provided with projections having inclined surfaces which cooperate with two extension arms of the connection element in order to wedge the components together.

10. A two-piece thermally-insulating resilient connecting element arrangement for the coupling of two components, each component having a receiving channel therein, one piece of the connecting element arrangement being shaped for engagement within said channels so that at least two surfaces of said one piece are contiguous with each receiving channel, the other piece of said connecting element arrangement directly engaging and causing deformation of said one piece to cause said one piece to wedge against the contiguous surfaces of each receiving channel to retain said components in mutual engagement by interaction of (i) a wedging force urging said channels toward each other and (ii) an oppositely directed spacing force maintaining said channels at a desired distance from each other, both said wedging force and said spacing force being exerted on said channels by said one piece.

11. A thermally-insulating connecting device intended for the coupling of two components and comprising a resiliently deformable connecting element which is insertable into receiving channels on the components, said connecting element being shaped for engagement within said receiving channels and, after having been inserted into said receiving channels, to be changed in its dimensions by inserting a locking element so that a connection of the components is formed by resiliently deforming said connection element by means of said locking element, to urge said connecting element against interior walls of each of said receiving channels and position said channels by interaction of (i) a wedging force urging said channels toward each other and (ii) maintaining said channels at a desired distance from each other, both said wedging force and said spacing force being exerted on said channels by said one piece.

12. The device according to claim 11, characterized by the fact that the locking element is removably engaged with the connecting element.

13. The device according to claim 12, characterized in that the locking element serves as a spacer for the components after the connecting device has been installed.

14. The device according to claim 12, characterized in that the locking element consists of a harder material than the connecting element.

15. A thermally-insulating connecting device intended for the coupling of two components and comprising a first connecting element which is insertable into receiving channels on the components, said connecting element being adapted to be easily pushed into said receiving channels as a result of its shape and provided with ridges fitting into slots of the components, and further comprising a hammer headshaped second connecting element which is adapted to be locked with the first connecting element by a removalbe clamping means, and which has inclined wedge surfaces cooperating with corresponding inclined surfaces of projections of the components so that a connection of the components is formed by a wedge action between the second connecting element and the components, resulting in a first force tending to draw said components toward each other and a second oppositely directed force tending to maintain said components at a desired distance from each other.

16. The device according to claim 15, characterized by the fact that the slots are arcuate.

17. The device according to claim 15, characterized by the fact that the slots are conical slots.

18. The device according to claim 15, characterized by the fact that inclined surfaces are arranged in the slots, the first connecting element having inclined surfaces for engaging said first-mentioned inclined surfaces.

19. The device according to claim 15, characterized in that clamps are arranged on the first connecting element, said clamps having inclined surfaces the ends of which run to a point and lock into a harpoon-like arm of the second connecting element.

20. The device according to claim 15, characterized by the fact that a third connecting element is provided symmetrical to the second connecting element and comprised corresponding wedge surfaces and catching means.

21. The device according to claim 15, characterized by the fact that the catching projections are so arranged that a tensioning force occurs when the second connecting element is inserted into the first connecting element, in a direction drawing said connecting elements toward each other.

22. The device according to claim 15, characterized by the fact that the wedge surfaces on the components are so arranged that a tensioning force occurs in a direction drawing said channels toward each other.

23. The device according to claim 15, characterized by the fact that two extension arms are provided on the first connecting element, said arms having inclined surfaces cooperating with corresponding inclined surfaces of the second connecting element so that the two upper extensions of the first connecting element are pushed outwards to apply a separating force to said channels.

* * * * *